US006215239B1

(12) United States Patent
Jansen et al.

(10) Patent No.: US 6,215,239 B1
(45) Date of Patent: Apr. 10, 2001

(54) CRT DEFLECTION UNIT HAVING A COOLING FIN

(75) Inventors: Martinus H. E. Jansen; Arnoldus M. C. Kieboom, both of Eindhoven (NL)

(73) Assignee: U.S. Philips Corporation, New York, NY (US)

( * ) Notice: Subject to any disclaimer, the term of this patent is extended or adjusted under 35 U.S.C. 154(b) by 0 days.

(21) Appl. No.: 09/391,815

(22) Filed: Sep. 8, 1999

(30) Foreign Application Priority Data

Sep. 11, 1998 (EP) ..... 98203055

(51) Int. Cl.[7] ..... H01J 29/70

(52) U.S. Cl. ..... 313/440; 165/80.3; 165/181; 165/182; 313/442; 313/413

(58) Field of Search ..... 313/440, 442, 313/413; 335/300, 210, 211, 212; 165/80.3, 80.1, 80.2, 181, 182

(56) References Cited

U.S. PATENT DOCUMENTS

| | | | | |
|---|---|---|---|---|
| 2,089,340 | * | 8/1937 | Cobb | 165/182 |
| 2,140,442 | * | 12/1938 | Clark | 165/182 |
| 2,402,262 | * | 6/1946 | Sewell | 165/80.3 |
| 2,475,604 | * | 7/1949 | Frisch et al. | 165/182 |
| 2,737,370 | * | 3/1956 | Frisch et al. | 165/181 |
| 2,964,688 | * | 12/1960 | McAdam | 165/80.3 |
| 4,737,752 | | 4/1988 | Kriz | 335/210 |
| 5,138,290 | * | 8/1992 | Togane et al. | 313/440 |
| 5,598,055 | * | 1/1997 | Inoue et al. | 313/440 |
| 5,668,436 | * | 9/1997 | Honda et al. | 313/440 |
| 5,675,213 | * | 10/1997 | Huang et al. | 313/440 |

FOREIGN PATENT DOCUMENTS

| | | | |
|---|---|---|---|
| 5114370 | 5/1993 | (JP) | H01J/29/76 |

OTHER PUBLICATIONS

Japanese Abstracts: 6–243798(A), Sep. 2, 1994; 6–162962(A), Jun. 10, 1994; 4–123750(A), Apr. 23, 1992; 3–155028(A), Jul. 3, 1991; 3–152835(A), Jun. 28, 1991; 3–43941(A), Feb. 25, 1991; 1–200542(A), Aug. 11, 1989; 61–126744(A), Jun. 14, 1986; 61–126745(A), Jun. 14, 1986;.

* cited by examiner

*Primary Examiner*—Michael H. Day
*Assistant Examiner*—Mariceli Santiago

(57) ABSTRACT

A cathode ray tube includes a deflection unit (11) having a cooling fin (25) which is attached to the surface of a tapering surface on a yoke ring (23) by lugs (27). At least one of the lugs has a free end extending axially and outwardly in thermal contact with the tapering surface, and at least another of the lugs has a free end extending axially in an opposite direction and inwardly in thermal contact with the tapering surface.

16 Claims, 3 Drawing Sheets

CRT DEFLECTION UNIT HAVING A COOLING FIN

BACKGROUND OF THE INVENTION

The invention relates to a cathode ray tube comprising means for generating at least one electron beam, a display screen and a deflection unit having coils for deflecting the electron beam(s) across the display screen, and a yoke ring which surrounds at least one of the coils, said yoke ring being provided with at least one cooling fin for dissipating heat generated by the coils, said cooling fin thermally contacting the yoke ring by means of lugs which contact a surface of the yoke ring. The invention also relates to a cooling fin for use in a cathode ray tube.

Cathode ray tubes are well known and are used, inter alia, in television receivers and computer monitors. A yoke ring having cooling fins for a cathode ray tube is known from JP-A 5-114370.

In operation, the deflection unit deflects the electron beam(s). The yoke ring surrounds the coils and enhances the field generated by the coils.

An important problem resides in that the temperature of the deflection unit increases during operation. The deflection unit warms up. This causes a number of problems. The different parts of the deflection unit expand and may move relatively to each other. These phenomena have a negative influence on the picture display. In the known yoke ring, the cooling fins are provided so as to dissipate heat.

BRIEF SUMMARY OF THE INVENTION

It is an object of the invention to provide a cathode ray tube of the type mentioned in the opening paragraph, in which one or more of the above-mentioned problems are reduced in that the thermal contact between the cooling fin and the yoke ring is improved.

To achieve this, a cathode ray tube in accordance with the invention is characterized in that some of the lugs of the cooling fin are arranged so as to face the display screen with their respective free ends, and other of the lugs are arranged so as to face away from the display screen with their respective free ends.

As a result of this measure, the lugs of the cooling fins are operative on a larger effective contact surface of the yoke ring. This results in an improvement of the cooling effect of the cooling fin as well as an improved fixation of the cooling fin to the yoke ring. In addition, the possibility of adapting the cooling fin to the local shape of the yoke ring is further increased.

A favorable embodiment of a cathode ray tube in accordance with the invention is characterized in that the lugs are arranged in groups of three and, within a group, the central lug points with its free end in a direction which is opposite to the direction in which the outermost lugs point with their free ends.

This structure helps to obtain a desirably contacting cooling fin. This measure additionally results in the formation of a large effective contact surface, causing the deflection unit to be properly cooled.

Another favorable embodiment of a cathode ray tube in accordance with the invention is characterized in that, within a group of lugs, the central lug faces the display screen with its free end, and the two outer lugs face away from the display screen with their free ends. By virtue of this embodiment, it is precluded that, during providing the cooling fin around the yoke ring, in which process large forces are exerted on the cooling fin, the cooling fin is subject to deformation.

A further favorable embodiment is characterized in that the cooling fin is ring-shaped and provided with a circularly-symmetrical ridge, which is situated between the lugs and the outer circumference of the cooling fin. By virtue thereof, it is achieved that a good mechanical and thermal contact between the cooling fin and the yoke ring is maintained when said yoke ring is subject to thermal expansion.

An advantageous embodiment is characterized in that the cooling fin is provided with grooves or slits extending in a radial direction. As a result thereof, the resilient effect of the lugs is further improved, so that any deviations from a truly round shape of the yoke ring can be properly dealt with. This embodiment also increases the dimensional tolerances of the yoke ring.

These and other aspects of the invention will be apparent from and elucidated with reference to the embodiment(s) described hereinafter.

BRIEF DESCRIPTION OF THE SEVERAL VIEWS OF THE DRAWINGS

In the drawings.

The Figures are diagrammatic and not drawn to scale; in general, like reference numerals refer to like parts.

DETAILED DESCRIPTION OF THE INVENTION

Figure 1:
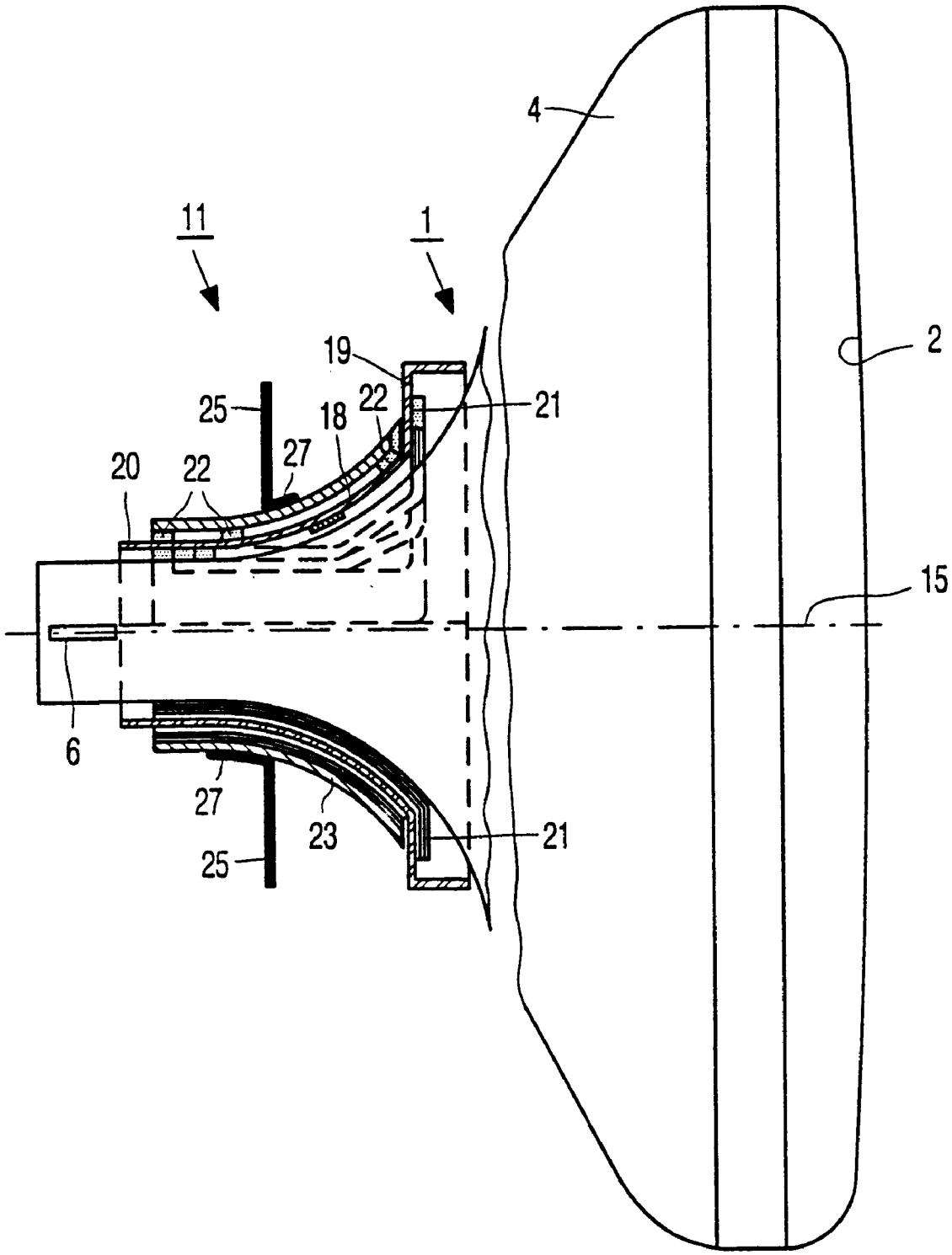
FIG. 1 is a cross-sectional view of a cathode ray tube provided with a cooling fin in accordance with the invention.

FIG. 1 is a schematic, sectional view of a known design of a cathode ray tube comprising a deflection unit 11. In the Figure, a tube axis is indicated by reference numeral 15. Said tube axis 15 substantially coincides with the axis of symmetry of the deflection unit 11. Said deflection unit includes a coil holder 18 of an electrically insulating material (often a synthetic resin) having a front end portion 19 and a rear end portion 20. A line deflection coil system 21 is situated on the inside, between these end portions, which line deflection coil system serves to generate a (line) deflection field for deflecting electron beams generated by an electron gun 6 in the horizontal (line) direction, and on the outside of the coil holder, there is a frame deflection coil system 22 for generating a (frame) deflection field in the vertical direction. Each coil system 21, 22 generally includes two sub-coils. The deflection unit further comprises a yoke ring 23 which is provided with a cooling fin 25 in accordance with the invention. The yoke ring has an axially extending external surface tapering outwardly toward the display screen. The cooling fin 25 is secured to the yoke ring 23 by means of lugs 27 having free ends respectively extending axially and either inwardly or outwardly for good thermal contact with the external surface.

Both coil systems 21, 22 are attached to the coil holder 18. In operation, the temperature of the cathode ray tube 1, and particularly of the deflection unit 11, increases. The coil systems 21, 22 are attached (for example using an adhesive or hooks) to the coil holder 18. When the temperature increases, differences in temperature and thermal expansion between the coil systems 21, 22, the coil holder 18 and the yoke ring 23, cause differences in the relative positions of these elements. These changes have a negative effect on the quality of the image displayed.

In practice, it has been found that a decrease in temperature of 5 to 15° C. of the line deflection coil system 21 can be brought about by using cooling fins 25. The actual temperature decrease depends upon the number of cooling fins 25 used and on the operating temperature of the coil systems 21, 22.

In practice, a number of two to three cooling fins 25 yields a good balance between, on the one hand, the cooling effects and, on the other hand, business-economics related considerations such as the additional cost of extra cooling fins.

Figure 2A:
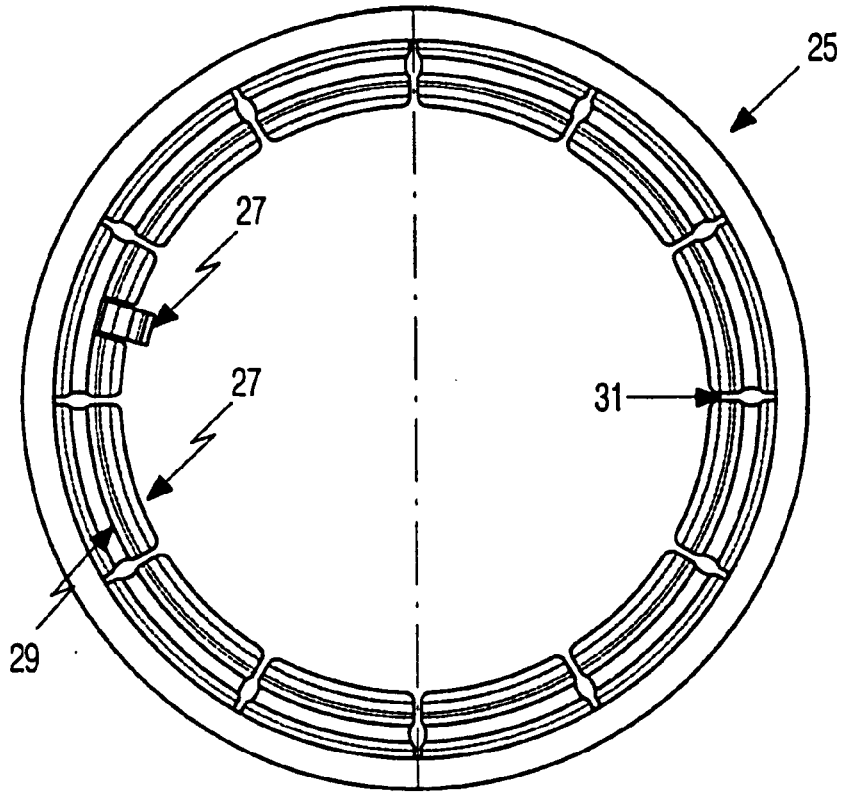
FIGS. 2A, 2B show, respectively, a plan view and a side view of the cooling fin.
Figure 2B:
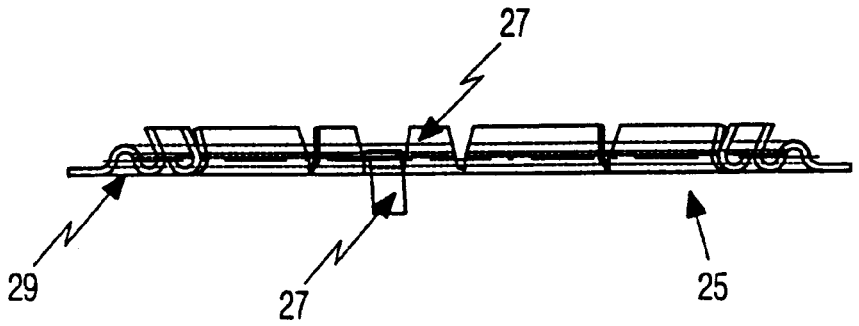

FIGS. 2A and 2B show, respectively, a plan view and a side view of a ring-shaped cooling fin 25. Said cooling fin 25 is provided with lugs 27, a ridge 29 and radial slits 31 extending between the lugs 27 and through the ridge 29 to an outer circumferential portion free from the slits. The ridge 29 is provided to cope with the thermal expansion of the yoke ring 23 in the radial direction in order to ensure that proper mechanical and thermal contact between the cooling fin 25 and the yoke ring 23 is maintained. The radial slits are provided to further improve the resilient effect of the lugs 27, so that any deviations from the truly round shape of the yoke ring 23 can be satisfactorily dealt with. This also leads to larger dimensional tolerances of the yoke ring 23, which has a favorable effect on the cost price of the yoke ring.

A further improvement of the cooling result is achieved by using a heat-conducting adhesive, for example Eccobond 50248F15 (commercially available from ICI Belgium), between the lugs 27 and the yoke ring 23, resulting in a satisfactory heat transfer between the cooling fin 25 and the yoke ring 23.

Figure 3:
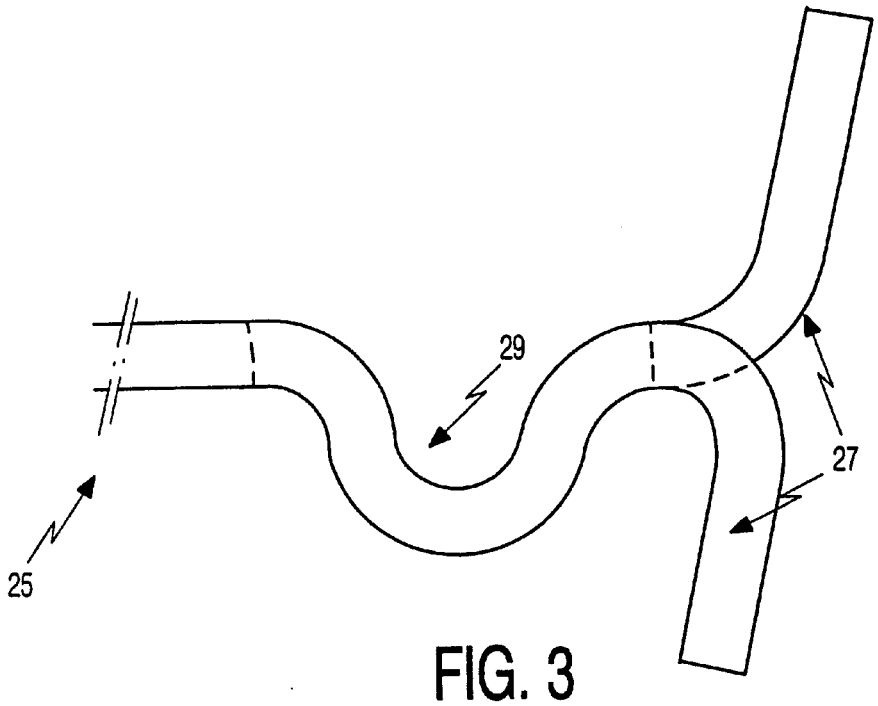
FIG. 3 is a radial sectional view of a cooling fin, a ridge and lugs being shown.

FIG. 3 is a cross-sectional view of a cooling fin 25, in which a ridge 29 and lugs 27 are depicted. The angles included by the lugs 27 and the radial plane of the cooling fin 25 can be accurately adapted to the local shape of the yoke ring at the location of the attachment. By virtue thereof, a good contact between the cooling fin 25 and the yoke ring 23 is obtained.

Figure 4A:
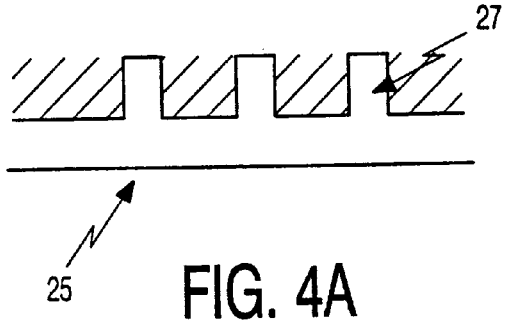
FIGS. 4A, 4B are schematic, radial sectional views of a cooling fin including lugs.
Figure 4B:
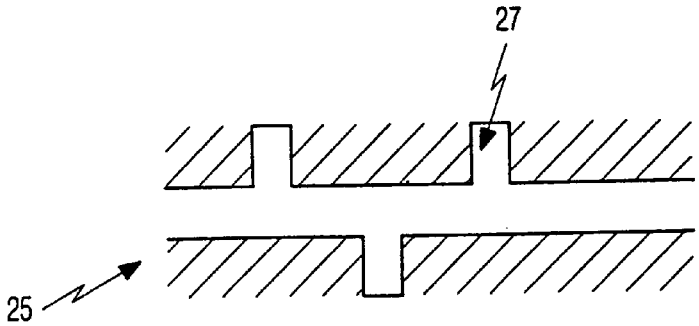

FIGS. 4A, 4B are schematic, radial sectional views of a cooling fin 25 having lugs 27, and they also show the effective surface area of the yoke ring 23 on which the clamping forces exerted by the lugs 27 of the cooling fin are active. FIG. 4A shows a situation in which the lugs 27 point in the same direction. FIG. 4B shows a situation in which the lugs 27 in accordance with the invention point in different directions. The hatched region represents the effective surface. It has been experimentally established that in situation B, the cooling fin 25 is deformed less readily during providing the cooling fin 25 around the yoke ring 23.

Preferably, the cooling fin 25 is made of anodized aluminum. It has been found that anodized aluminum enables a good heat radiation to be obtained. An additional advantage of aluminum relative to other metals is that it is light, which is a favorable property for this application. Besides, aluminum can be readily processed.

The cooling fin 25 has the advantage that it can be added after the manufacture of the cathode ray tube 1. Consequently, application of the cooling fin 25 does not require changes in the manufacturing process of the cathode ray tube or in the design of the deflection unit.

Measurements have shown that the application of the cooling fin 25 does not adversely affect the image quality of the cathode ray tube 1 as regards the frame, convergence or landing.

The invention can be briefly summarized as follows:

A deflection unit 11 for, or of, a cathode ray tube 1 comprises at least one cooling fin 25 which, by means of lugs 27, engages a surface of the yoke ring 23. A part of the lugs 27 are arranged so as to face the display screen 10 with their free end, and another part of the lugs 27 is arranged so as to face away from the display screen 10 with their free end.

It is noted that the above-mentioned embodiments are used to explain the invention, but that the invention is not limited thereto. Experienced persons skilled in the art will doubtlessly be capable of designing many alternative embodiments without surpassing the scope of protection of the appended claims. In the claims, the reference numerals in brackets are not to be interpreted as limiting the scope of the claims. The term "comprise" does not exclude the presence of steps or means other than those mentioned in a claim.

What is claimed is:

1. A cathode ray tube (1) comprising means (6) for generating at least one electron beam, a display screen (2), a deflection unit (11) having coils (21, 22) for deflecting the electron beam(s) across the display screen (2), and a yoke ring (23) which surrounds at least one of the coils (21, 22), said yoke ring (23) being provided with at least one cooling fin (25) for dissipating heat generated by the coils (21, 22), said cooling fin (25) thermally contacting the yoke ring by means of a plurality of lugs (27) which contact a surface of the yoke ring (23), characterized in that at least one of the lugs (27) of the cooling fin (25) is arranged so as to face the display screen (2) with a thermally contacting surface free end, and at least another of the lugs (27) is arranged so as to face away from the display screen (2) with a thermally contacting surface free end.

2. A cathode ray tube (1) as claimed in claim 1, characterized in that the lugs (27) are arranged in groups of three and, within a group, the central lug (27) points with its free end in a direction which is opposite to the direction in which the outermost lugs (27) point with their free ends.

3. A cathode ray tube as claimed in claim 2, characterized in that the central lug (27) faces the display screen (10) with its free end, and the two outer lugs (27) face away from the display screen (10) with their free end.

4. A cathode ray tube (1) as claimed in claim 1, characterized in that the cooling fin (25) is ring-shaped and provided with a circularly-symmetrical ridge (29), which is situated between the lugs (27) and an outer circumference of the cooling fin (25).

5. A cathode ray tube (1) as claimed in claim 1, characterized in that the cooling fin (25) is provided with grooves (31) extending in a radial direction.

6. A cathode ray tube (1) comprising means (6) for generating at least one electron beam, a display screen (2), a deflection unit (11) having coils (21, 22) for deflecting the electron beam(s) across the display screen (2), and a yoke ring (23) which surrounds at least one of the coils (21, 22), said yoke ring (23) having an axially extending external surface tapering outwardly toward the display screen and being provided with at least one cooling fin (25) for dissipating heat generated by the coils (21, 22), said cooling fin (25) thermally contacting said surface by means of a plurality of lugs (27), characterized in that at least one of the lugs (27) is arranged with a free end extending axially toward the display screen (2) and outwardly to be in thermal contact with said surface, and at least another of the lugs (27) is arranged with a respective free end extending axially away from the display screen (2) and inwardly to be in thermal contact with said surface.

7. A cathode ray tube (1) as claimed in claim 6, characterized in that the cooling fin (25) is provided with radial slits (31) extending between said lugs to an outer circumferential portion free from said slits.

8. A cathode ray tube (1) as claimed in claim 6, characterized in that the lugs (27) are arranged in groups of three and, within a group, a central lug (27) points with its free end in a direction which is opposite to the direction in which the outermost lugs (27) point with their free ends.

9. A cathode ray tube (1) as claimed in claim 8, characterized in that the central lug (27) faces the display screen (10) with its free end, and the two outer lugs (27) face away from the display screen (10) with their free end.

10. A cathode ray tube (1) as claimed in claim 6, characterized in that the cooling fin (25) is ring-shaped and provided with a circularly-symmetrical ridge (29), which is situated between the lugs (27) and an outer circumference of the cooling fin (25).

11. A cathode ray tube (1) as claimed in claim 10, characterized in that the cooling fin (25) is provided with radial slits (31) extending between said lugs and through said ridge, and said outer circumferential portion is free from said slits.

12. A cooling fin (25) for dissipating heat from an object having a tapering surface, comprising:

a substantially planar circumferential portion, and a plurality of lugs (27) for contacting the tapering surface of the object, characterized in that at least one of the lugs (27) of the cooling fin (25) is arranged with a free end extending axially in a first direction and outwardly to be in thermal contact with said tapering surface, and at least another of the lugs (27) is arranged with a respective free end extending axially in a direction opposite to said first direction and inwardly to be in thermal contact with said surface.

13. A cooling fin (25) as claimed in claim 12, characterized in that the cooling fin (25) is provided with radial slits (31) extending between said lugs to an outer portion of said circumferential portion free from said slits.

14. A cooling fin (25) as claimed in claim 12, characterized in that the lugs (27) are arranged in groups of three and, within a group, the central lug (27) points with its free end in a direction which is opposite to the direction in which the outermost lugs (27) point with their free ends.

15. A cooling fin (25) as claimed in claim 12, characterized in that the cooling fin (25) is ring-shaped and provided with a circularly-symmetrical ridge (29), which is situated between the lugs (27) and said substantially planar circumferential portion.

16. A cooling fin (25) as claimed in claim 15, characterized in that the cooling fin (25) is provided with radial slits (31) extending between said lugs and through said ridge, and said substantially planar circumferential portion is free from said slits.

* * * * *